United States Patent [19]

Wanner

[11] 4,072,199

[45] Feb. 7, 1978

[54] MOTOR-DRIVEN PORTABLE HAMMER

[75] Inventor: Karl Wanner, Echterdingen, Germany

[73] Assignee: Robert Bosch GmbH, Stuttgart, Germany

[21] Appl. No.: 330,257

[22] Filed: Feb. 7, 1973

[30] Foreign Application Priority Data

Feb. 21, 1972 Germany ..... 2207961

[51] Int. Cl.[2] ..... B25D 17/04; B25D 17/08

[52] U.S. Cl. ..... 173/131; 173/133; 173/139; 173/162

[58] Field of Search ..... 173/139, 162, 133, 13; 267/137; 279/19

[56] References Cited

U.S. PATENT DOCUMENTS

| | | | |
|---|---|---|---|
| 1,896,992 | 2/1933 | Agren | 173/139 X |
| 2,440,834 | 5/1948 | Sims | 173/17 |
| 2,936,743 | 5/1960 | Colgate | 173/139 X |
| 3,266,581 | 8/1966 | Cooley et al. | 173/162 |
| 3,326,303 | 6/1967 | Jones, Jr. | 173/133 X |
| 3,404,877 | 10/1968 | Darnell | 267/137 |

*Primary Examiner*—Ernest R. Purser
*Assistant Examiner*—William F. Pate, III
*Attorney, Agent, or Firm*—Michael J. Striker

[57] ABSTRACT

A housing has a tool mounted therein so that a portion of the tool can slide for reciprocatory movement deeper into and farther out of the housing. A prestressed biasing spring or a cushion of gas is interposed between and acts upon the housing and the aforementioned portion of the tool, being prestressed to an extent which is less than the minimum force with which the tool can engage a workpiece when the tool is pushed against the workpiece by the weight of the hammer, and which biasing means has a flat spring characteristic.

7 Claims, 5 Drawing Figures

MOTOR-DRIVEN PORTABLE HAMMER

BACKGROUND OF THE INVENTION

The present invention relates generally to portable motor-driven hammers, and more particularly to an apparatus of this type wherein the hammer-tool holder is spring loaded.

Portable motor-driven hammers and hammer drills are already known. They have a housing in which the tool is journalled, that is a portion of the tool extends into the housing and can slide farther into and farther out of the housing in operation. A rapidly reciprocating strike member is provided in the housing which either strikes the inner end of the tool directly, or strikes an anvil serving to seal the interior of the housing, and which anvil in turn transmits force to the inner end of the tool. In either case, this rapid impacting on the tool causes the desired effect upon the workpiece, for instance upon rock, masonry or the like.

In these constructions the anvil as well as the tool are axially freely movable within certain limits which are determined by appropriate abutments. The movement of the anvil, if one if provided, in the direction towards the handle of the tool, that is the direction where the user holds the tool, is limited by a spring abutment having a spring which is so strongly prestressed that in the case of light-weight hammers the force exerted by the spring is greater than the greatest force with which a user can press the tool of a hammer against a workpiece, and in the case of heavy hammers which are used always in downward direction, the force is greater than the weight of the hammer plus the force exerted by a user. This spring abutment serves to dampen the so-called B-impacts, which tend to vibrate the hammer and be transmitted to the user.

However, there are certain disadvantages involved in these prior-art constructions. The free axial movement of the tool and of the anvil, if one is provided, has the drawback that at the moment at which the impactor impacts the tool or the anvil the tool will frequently not be in contact with the workpiece, and the anvil will not be in contact with the tool. This means that the energy yielded by the impactor upon the anvil directly, or upon the tool directly, is not immediately available for the desired working operation, but is first needed to accelerate the tool, or the anvil plus the tool, in forward direction. This results in longitudinal vibrations of the anvil and the tool which have been observed as using up a significant portion of the energy supplied by the impactor. Evidently, this is undesirable, but heretofore no way has been proposed to overcome this drawback.

SUMMARY OF THE INVENTION

It is, accordingly, an object of the present invention to provide an improved motor-driven portable hammer.

Still more particularly it is an object of the present invention to provide such an improved hammer in which the tool will be in contact with the workpiece at the moment of impact by the impactor, and in which an anvil — if one is provided — will be in contact with the inner end of the tool at the moment of impact by the impactor.

In keeping with these objects and with others which will become apparent hereafter, one feature of the invention resides, in a motor-driven portable hammer whose tool presses against the workpiece with a minimum force determined by the weight of the hammer, in a combination comprising a housing, a tool having a portion slidably journalled in this housing for reciprocatory movement deeper into and farther out of the housing, and prestressed biasing means interposed between and acting upon the housing and the aforementioned portion of the tool. According to the invention the biasing means is prestressed to an extent which is less than the aforementioned minimum force, and it has a flat spring characteristic. The term flat spring characteristic means that the spring force of the biasing means will vary only slightly during the longitudinal movements of the tool or the tool plus the anvil.

According to a concept of the invention it is possible to provide a shiftable mechanical intermediate element between the biasing means and the tool, or more than one such mechanical element can be provided. One of these mechanical elements can be configurated as an anvil or, if the hammer is of the hammer-drill type, it can be configurated as a drill holder.

The biasing means may be in form of a spring but can also be in form of a cushion of compressed gas or air inside the housing, as long as the gas or air is prestressed to a pressure which is greater than the pressure of the ambient atmosphere.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 6 is a fragmentary longitudinal section showing a further embodiment of the invention.

DESCRIPTION OF THE PREFERRED EMBODIMENTS

Figure 1:
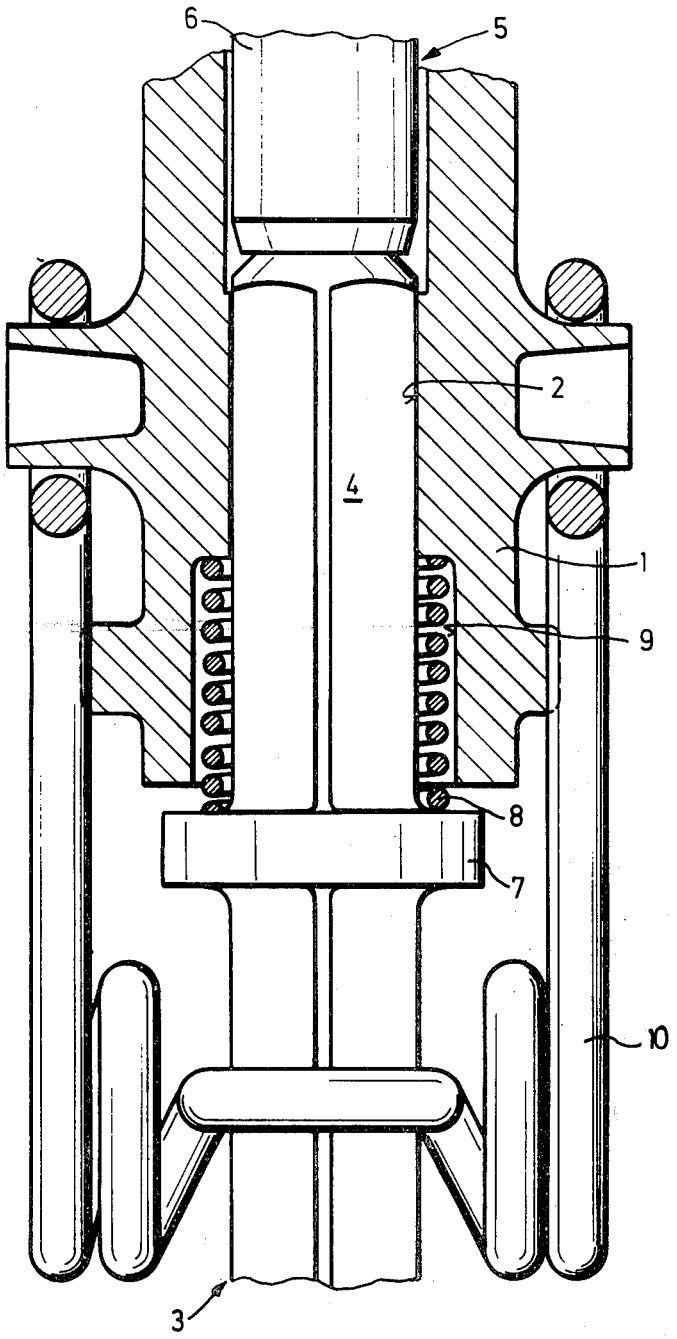
FIG. 1 is a longitudinal section with the front portion of a hammer incorporating one embodiment of the invention.

Before entering into a detailed discussion of the drawing it is pointed out that for the sake of simplicity two terms will be defined and used hereafter, namely the term "tool side" which means the front end of the hammer in the direction towards the workpiece, and "gripping side" which means the rear end of the hammer in the direction towards the hands of a holder or user.

Coming now to the embodiment illustrated in FIG. 1 it will be seen that here reference numeral 1 identifies a fragmentarily illustrated housing of the hammer, having a bore 2 in which there is guided a tool 3 (hammer or a hammer drill) having a shaft 4 which is reciprocable in the bore 2. An impactor 5 is also located in the housing 1, being reciprocable and having a shaft 6 which impacts during forward movement upon the gripping side end portion of the shaft 4 of the tool 3.

As the drawing clearly shows, a flange 7 is provided on the shaft 4 of the tool 3 and a pressure spring 8 is provided in the housing which surrounds the shaft and is accommodated in a recess 9. The spring 8 bears against the flange 7 on the one hand and against the housing, namely the bottom of the recess 9 on the other hand. An additional spring 10 is provided which in the illustrated manner prevents the tool 3 from moving out of the bore 2.

The spring 8 is the biasing means and has a prestress which is so-selected that it is greater than the weight of the tool 3, but smaller than the minimum force with which the tool 3 can engage a workpiece, that is smaller than the weight of the hammer which will obviously constitute the minimum force at which the tool can contact the workpiece when the tool is rested on the workpiece under the influence of the weight of the hammer. This construction is particularly advantageous for compressed air hammers and for those types of hammers having an electrical drive motor but no anvil intermediate the tool and the impactor.

Figure 2:
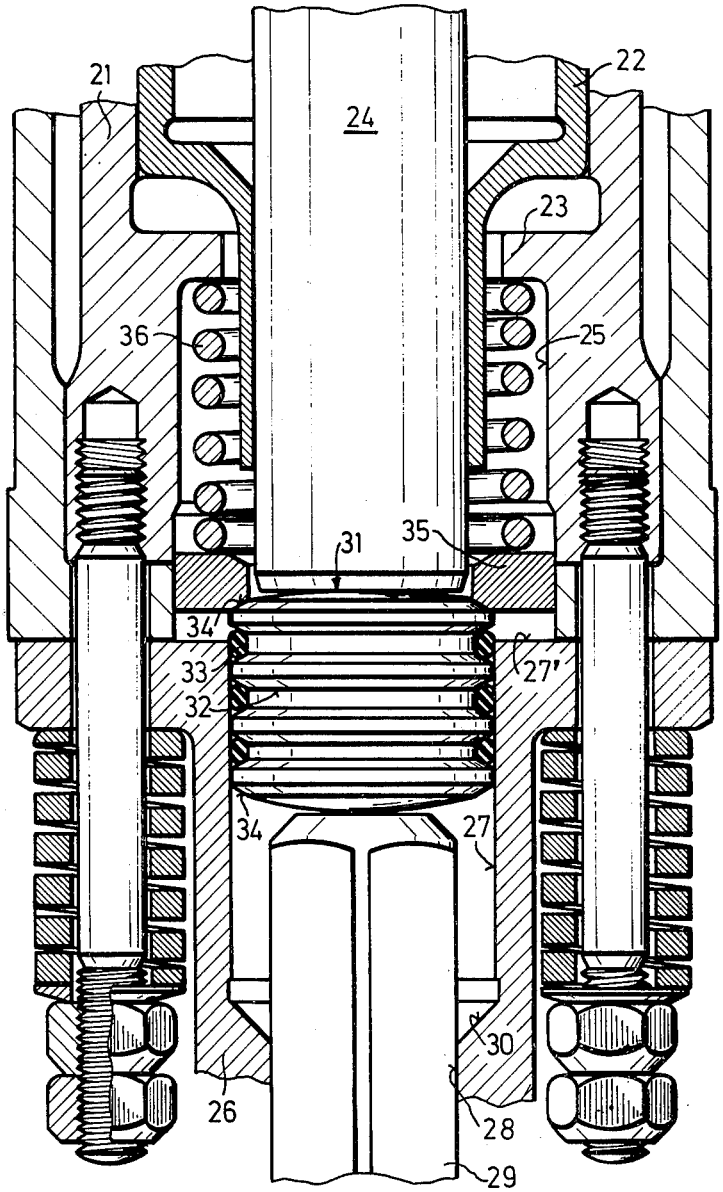
FIG. 2 is a view similar to FIG. 1 but of a second embodiment of the invention.

The embodiment in FIG. 2 utilizes, contrary to that of FIG. 1, an anvil between the impactor and the tool. The housing is identified with reference numeral 21 and a cylinder 22 is slidably accommodated in the housing and may be reciprocated via a non-illustrated drive, for instance by means of a crank drive. An impactor is reciprocably accommodated in the cylinder 22 and only the shaft 24 of the impactor is shown. Coaxially with the impactor the housing 21 is provided with a bore 25 which surrounds with spacing the tool side portion of the cylinder 22 with the shaft 24 of the impactor which is guided therein. At the gripping side the bore 25 is delimited by a radially inwardly projecting flange 23 of the housing.

The housing 21 has secured to it at the tool side a tool holder 26 which has a bore 26 coaxial with the impactor whose shaft 24 is shown, and the bore 27 is narrower than the bore 25. The head of the bore 27 is provided a guide 28 which is also coaxial with the bore 27, for guiding a tool 29; the guide 28 is configurated as an internal hexagon and connected with the bore 27 via a hollow conical surface 30.

An anvil 31 is reciprocably accommodated in the bore 27, being of cylindrical configuration and provided on its outer circumferential surface with annular grooves 32 which accommodate sealing rings 33. Both the opposite ends of the anvil 31 are grounded and the transitions between the rounded surfaces and the cylinder circumferential surface are configurated as conical surfaces 34.

An abutment ring 35 is shiftably accommodated in the bore 25; at the gripping side the ring 35 is supported with respect to the inner flange 23 of the housing 21 via a pressure spring 36. At the tool side the path of movement of the ring 35 is delimited by a shoulder 27' of the tool holder 26 which projects ahead of the bore 25 of the housing.

In this embodiment it is the spring 36 which constitutes the biasing means. In the prior art, from which this basic arrangement is known, the force of the spring 36 is greater (in the case of lightweight hammers) than the greatest force with which an operator can press the hammer and the tool against a workpiece, and in the case of heavy hammers which always operate only in downward direction, the force of the spring 36 is greater than the aforementioned greatest force plus the weight of the hammer.

By contrast, in accordance with the present invention the spring 36 has a prestress which is smaller than the smallest possible force with which the tool of the hammer can be pressed against a workpiece. This means that as soon as the tool is placed against the workpiece the tool and the spring will yield and the ring 35 will move between the abutment shoulder 27' and the distance to which the spring 36 can be compressed, and will in all circumstances maintain the anvil in constant contact with the inner end of the tool, and the tool in constant contact with the workpiece on which the tool is to act. Thus, no energy of the impactor is lost in having to move the anvil into contact with the inner end of the tool, and/or to move the tool into contact with the workpiece.

The arrangement of FIG. 2 requires only a single spring, which of course is an advantage in terms of material and reduction of complexity. The so-called B-impacts will be well dampened if they are not very strong. However, in this arrangement it is possible that the spring 36 might become compressed to the full extent, so that all of its convolutions are in abutment with one another. In this case strong B-impacts will be transmitted to the housing and the user without being dampened, which is somewhat of a disadvantage. In addition, the axial position of the anvil at the moment at which the impactor contacts it, is dependent to some extent upon the force with which the tool is pressed against the workpiece so that the uniformity of impacts of the tool upon the workpiece leaves something to be desired.

Figure 3:
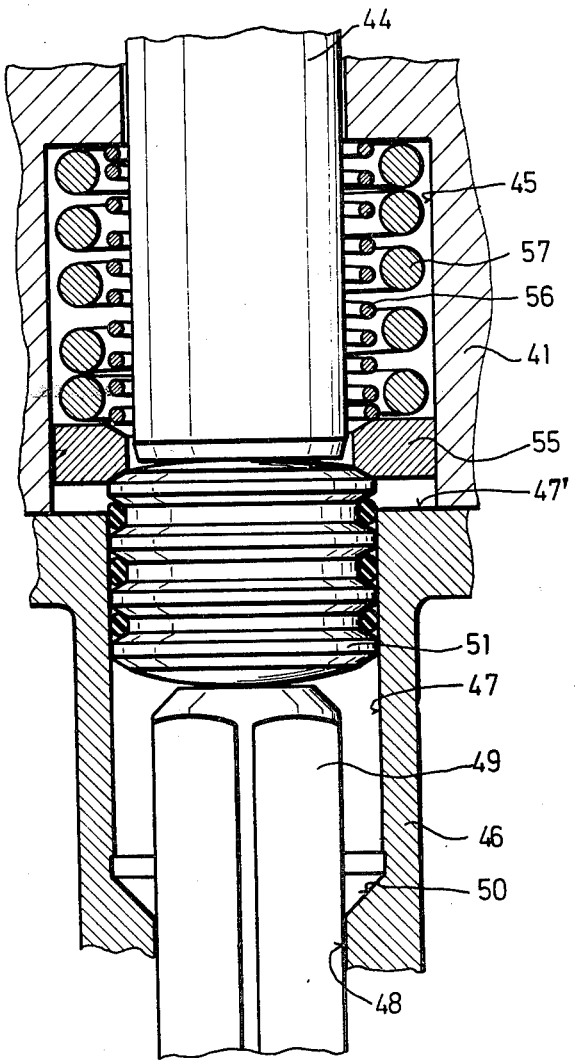
FIG. 3 is a view similar to FIG. 2 but illustrating an additional embodiment of the invention.

These problems are overcome in the embodiment illustrated in FIG. 3, where the housing of the hammer is identified with reference numeral 41. An impactor 44 is reciprocable in the housing 41 and is surrounded with spacing by a bore 45 in the region of the tool sided end of the impactor 44. A tool holder 46 is provided on the housing 41 and is secured with non-illustrated screws or the like. The tool holder has a bore 47 coaxial with the impactor 44 and narrower than the bore 45. At the tool side the bore 47 has a shoulder 47'. Ahead of the bore 47 the tool holder is provided with a guide 48 configurated as an internal hexagon and in this guide a tool 49 is reciprocably guided. A hollow conical surface 50 constitutes the transition from the bore 47 to the guide 48.

This embodiment also is provided with a substantially cylindrical anvil, here identified with reference numeral 51 and reciprocably guided in the bore 47. The anvil 51 can extend to some distance into the bore 45 of the housing 41, wherein an abutment ring 55 is displaceably guided. Two pressure springs 56 and 57 are provided which act upon the ring 55 and which both bear upon the housing at the gripping side. The spring 56 has a lesser spring force and urges the ring 55 against the shoulder 47'. The spring 57 is shorter but is stronger and when the ring 55 is displaced in the right direction towards the gripping side the spring 57 will begin to act upon the ring 55 only after the same has been displaced in the direction towards the gripping side counter to the force of the spring 56 by some distance.

It is of course the spring 56 which is the biasing means in this illustrated embodiment. The prestress of the spring 56 is smaller than the smallest force with which the tool of the hammer can be pressed against a workpiece, and it has a flat spring characteristic. The stress of the spring 57 is greater than the greatest force with which an operator can press the hammer and tool against a workpiece, plus the weight of the hammer.

It will be appreciated that in this embodiment the spring 56 will permanently cause the anvil to be in contact with the inner end of the tool, and the tool to be in contact with the workpiece, whereas the spring 57 delimits the axial position of the anvil at the gripping side at the moment of impact, and absorbs vibrations which occur in use. Thus, the position of the anvil with respect to the impactor is more precisely controlled in this embodiment so that the hammer according to the embodiment of FIG. 3 will operate more uniformly and quietly than that of FIG. 2. The damping of the B-impacts is substantially better than in the embodiment of FIG. 2.

Figure 4:
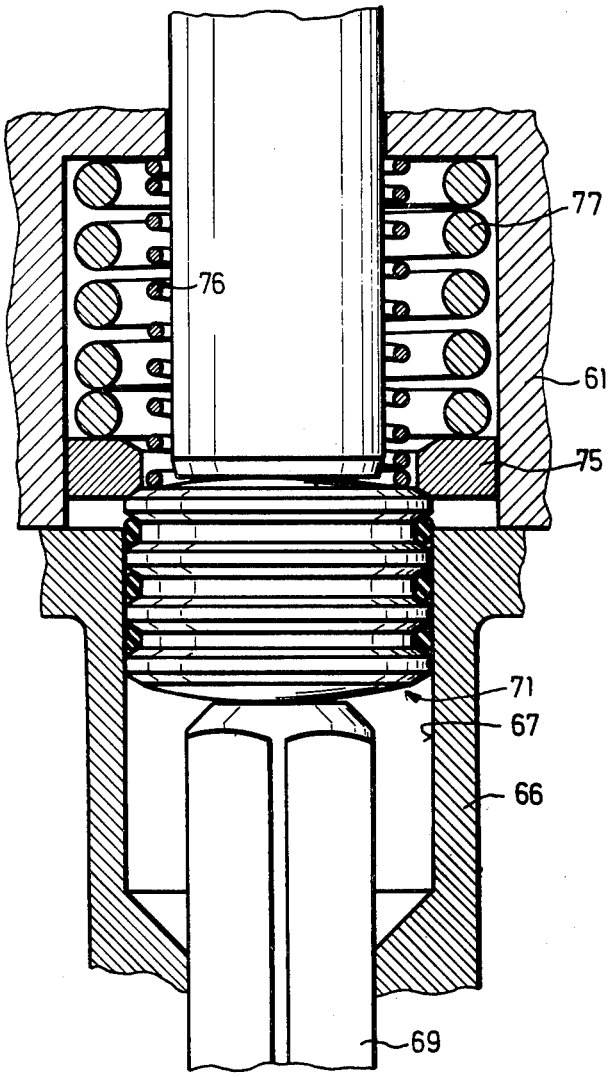
FIG. 4 is a view similar to FIG. 3 illustrating still a further embodiment of the invention.

The embodiment illustrated in FIG. 4 is a further development of that in FIG. 3. The hammer housing is identified with reference numeral 61 and accommodated there in it are again the anvil 71 and two springs 76 and 77. The spring 76 constitutes the biasing means and has a lesser prestress than the spring 77; it acts directly upon the anvil 71 and presses the same against the tool 69 when the anvil 71 performs reciprocatory movements within the bore 67 of the tool holder 66. An abutment ring 75 is provided which is supported with respect to the housing 61 via the second stronger spring 77 whose purpose is to dampen vibrations when the tool jumps and swings the anvil 71 against the abutment ring 75.

This embodiment also results in a more uniform impacting operation of the hammer, because the actual position of the anvil is more precisely controlled at the moment of impact by the impactor. In addition the anvil is in constant contact with the tool, and the latter is in constant contact with the workpiece over the entire possible path of displacement.

Figure 5:
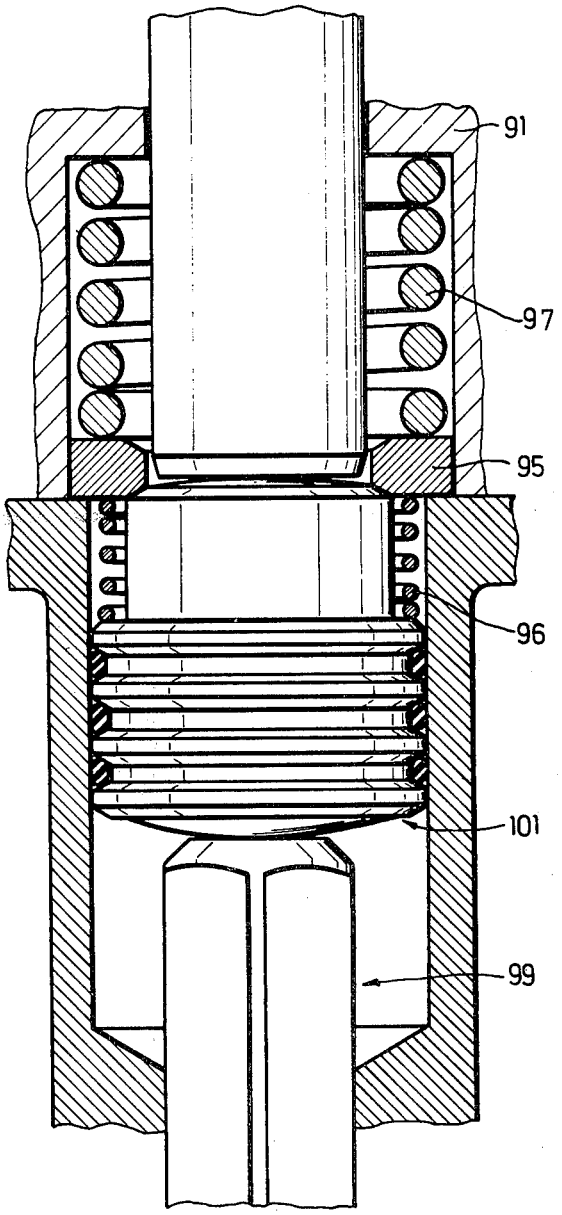
FIG. 5 is a view similar to FIG. 4 but illustrating yet another embodiment of the invention.

Coming to the embodiment of FIG. 5 it will be seen that here a somewhat smaller arrangement is provided. The biasing spring 96 is located between an abutment ring 95 and the anvil 101, and a stronger spring 97 is located and stressed between the ring 95 and the housing 91. In order to make it possible to provide an appropriate length for the spring 96, which cross constant contact of the anvil 101 with the tool 99 and of the tool with the workpiece, this embodiment — which has a bore in the tool holder in which the anvil 101 is guided — has its bore extended by the length of the spring 96. Its operation will be the same as in FIG. 4.

Depending upon the particular type of motor driven hammer with which the present invention is to be utilized, the wider arrangement of FIG. 4 or the longer arrangement of FIG. 5 might be used. The arrangements of FIGS. 2 and 3 can in most instances be used with existing hammers without having to make any structural changes, merely by exchanging springs so as to provide the biasing means according to the present invention in the existing structures.

It is, however, also possible to utilize a cushion of compressed gas or air as the biasing means. For instance, an air pump or the like could be used in place of the biasing springs. If the gas or air in the housing of the hammer is thus compressed (always assuming that the housing is appropriately gas tight) and is maintained under the increased pressure, then this gas or air cushion will act as the biasing means in the same manner as the biasing springs which have been discussed with respect to the embodiments of FIGS. 1–5. Of course, the compression must be appropriately greater than atmospheric pressure.

It will be understood that each of the elements described above, or two or more together, may also find a useful application in other types of constructions differing from the types described above.

While the invention has been illustrated and described as embodied in a motor driven hammer, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a motor-driven portable impactor, a combination comprising a hammer including a housing; an elongated tool slidably journalled in said housing for lengthwise movement inwardly and outwardly of the same; biasing means biasing said tool outwardly of said housing and being dimensioned to yield when the weight of said hammer bears upon said tool longitudinally thereof; at least one slidable intermediate member interposed between said biasing means and said tool, and having one end portion bearing upon said tool, and an other remote end portion, said biasing means comprising a first spring bearing upon said other end portion; a stronger second spring also bearing upon said other end portion; and abutment means bearing upon said springs remote from said other end portion and being adjustable in direction towards and away from the same.

2. A combination as defined in claim 1, wherein said intermediate member is an anvil.

3. A combination as defined in claim 1, wherein said intermediate member is a tool holder.

4. In a motor-driven portable impactor, a combination comprising a hammer including a housing; an elongated tool slidably journalled in said housing for lengthwise movement inwardly and outwardly of the same; biasing means biasing said tool outwardly of said housing and being dimensioned to yield when the weight of said hammer bears upon said tool longitudinally thereof; at least one slidable intermediate member interposed between said biasing means and said tool and having one end portion bearing upon said tool, and an other remote end portion, said biasing means comprising a first spring bearing upon said other end portion; an abutment engaging said first spring remote from said other end portion and being adjustably displaceable towards and away from said other end portion; and a second stronger spring bearing upon said abutment and said housing in at least substantial axial alignment with said first spring.

5. In a motor-driven portable impactor, a combination comprising a hammer indlucing a gas-tight housing; an elongated tool slidably journalled in said housing for lengthwise movement inwardly and outwardly of the same; biasing means comprising a cushion of gas at a pressure higher than atmospheric pressure biasing said tool outwardly of said housing and being yieldable when the weight of said hammer bears upon said tool longitudinally thereof; and at least one slidable intermediate member interposed between said biasing means and said tool.

6. In a motor-driven portable impactor, a combination comprising a hammer including a housing; an elongated tool slidably journalled in said housing for lengthwise movement inwardly and outwardly of the same; biasing means biasing said tool outwardly of said housing and being dimensioned to yield when the weight of said hammer bears upon said tool longitudinally thereof; at least one slidable intermediate member interposed between said biasing means and said tool and having one end portion bearing upon said tool, and an other remote end portion, said biasing means comprising a first spring bearing upon said other end portion and said housing; and a stronger second spring also bearing upon said housing and bearing upon said other end portion only during a terminal phase of the movement if said intermediate member inwardly of said housing.

7. In a motor-driven portable impactor, a combination comprising a hammer including a gas-tight housing; an elongated tool slidably journalled in said housing for lengthwise movement inwardly and outwardly of the same; and biasing means, comprising a cushion of gas at a pressure higher than atmospheric pressure biasing said tool outwardly of said housing and being yieldable when the weight of said hammer bears upon said tool longitudinally thereof.

* * * * *